US005993957A

United States Patent [19]

Kobayashi et al.

[11] Patent Number: 5,993,957

[45] Date of Patent: Nov. 30, 1999

[54] RECORDING MEDIUM CAPABLE OF REUSE

[75] Inventors: Tomoo Kobayashi; Kaoru Torikoshi, both of Minami-Ashigara; Tadakazu Ezure, Ashigarakami-gun, all of Japan

[73] Assignee: Fuji Xerox Co., Ltd., Tokyo, Japan

[21] Appl. No.: 09/105,465

[22] Filed: Jun. 26, 1998

Related U.S. Application Data

[62] Division of application No. 08/749,962, Nov. 18, 1996, Pat. No. 5,840,421.

[30] Foreign Application Priority Data

Nov. 22, 1995 [JP] Japan ..... 7-304308
May 24, 1996 [JP] Japan ..... 8-129710

[51] Int. Cl.[6] ..... B41M 5/00; G03G 7/00

[52] U.S. Cl. ..... 428/332; 430/126; 428/446; 428/447; 428/537.5; 428/913; 428/914

[58] Field of Search ..... 430/126; 428/332, 428/446, 447, 537.5, 913, 914

[56] References Cited

U.S. PATENT DOCUMENTS

| | | | |
|---|---|---|---|
| 5,302,576 | 4/1994 | Tokiyoshi et al. . | |
| 5,353,108 | 10/1994 | Tsukamoto . | |
| 5,378,675 | 1/1995 | Takeyama et al. . | |
| 5,418,057 | 5/1995 | Tokiyoshi et al. . | |
| 5,840,421 | 11/1998 | Kobayashi et al. | 428/332 |

FOREIGN PATENT DOCUMENTS

| | | |
|---|---|---|
| 0-392-790-A2 | 10/1990 | European Pat. Off. . |
| 0-402-898-A2 | 12/1990 | European Pat. Off. . |
| 0-434-073-A1 | 6/1991 | European Pat. Off. . |
| 0-743-562-A2 | 11/1996 | European Pat. Off. . |
| A-57-19753 | 2/1982 | Japan . |
| A-2-55195 | 2/1990 | Japan . |
| A-5-216376 | 8/1993 | Japan . |
| A-6-219068 | 8/1994 | Japan . |
| A-7-70502 | 3/1995 | Japan . |
| WO-95/29058 | 10/1995 | WIPO . |

*Primary Examiner*—Daniel Zirker
*Attorney, Agent, or Firm*—Oliff & Berridge, PLC

[57] ABSTRACT

A reusable image recording medium having improved capability of formation and removal of images such as toner images. The medium comprises a substrate and a coating formed on a surface of the substrate and having a recording surface with image forming material-peelability, wherein the recording surface has a surface smoothness of 200 seconds or lower as measured by a Bekk smoothness tester.

8 Claims, No Drawings

RECORDING MEDIUM CAPABLE OF REUSE

This is a Division of application Ser. No. 08/749,962 filed Nov. 18, 1996 now U.S. Pat. No. 5,840,421. The entire disclosure of the prior application(s) is hereby incorporated by reference herein in its entirety.

BACKGROUND OF THE INVENTION

1. Field of the Invention

The present invention relates to paper-like image recording media used in image forming devices based on electrophotography or thermal transfer and, more particularly, to reusable image recording media which are applied to an image forming device equipped also with a means for removing an image forming material such as ink from a substrate onto which the image forming material has been fixed, whereby image formation by the image forming materials and removal thereof can be repeated many times.

2. Description of Related Art

Recently, the global atmospheric problems have come to light and the importance of forest resource protection has been recognized. Reduction in utilization of wood resources as raw materials for paper has become an important problem. As one of remedies for reduction of the utilization, recycle of once used paper, without disposal as waste paper, is advanced now. Reuse of water paper is one of important means for recovering resources but has many problems, including leakage of confidential documents and/or data (particularly in companies or corporations), fractional recovery of different kinds of paper and transportation, as well as a storage space and administration of collected waste paper, in the recovery of waste paper. In the reuse of waste paper, fibers are shortened during re-pulping, leading to reduction in quality of reused paper, and an apparatus for deinking the images is further required. Since a paper-manufacturing machine is large, complex and expensive, the paper reuse can only be conducted by specific companies, not by an individual. Unless the fractional recovery, transportation, storage and operation of a huge apparatus are efficiently carried out, a large amount of energy will be consumed, i.e., the amount of $CO_2$ discharged will be increased, whereby the warming of the earth due to increase of $C_2$, which is also one of the global atmospheric problems, may be further accelerated.

In order to solve such a problem, there has been disclosed a method for reusing once used paper by erasing images thereon. For instance, reference may be made to the following methods.

Japanese Patent Application Laid Open (JP-A) No. 2-55195 discloses an image-erasable printing medium comprising a plastic, metal, liquid-impermeable paper or ceramic as an image support and a film of a silicone rubber releasing agent known as a silicone sealing agent coated on the surface of the support. The method for erasing an image comprises subjecting the image formed from a heat fusible ink on the support to heat and pressure through a heat fusible peeling medium followed by cooling the medium to have the image adhered to the peeling medium, thereby peeling off it from the support. The coating of the releasing agent can be migrated and partially adhered to the contract portions of, for example, a carrier roller when the agent is carried within the image forming apparatus, resulting in jamming of paper due to slipperiness. When this is repeated, the image surface may be stained since the toner floating within the apparatus may be adhered to the printed matters.

If the thickness of the coating is decreased to reduce the migration, the heat fusible ink can not be peeled out of the support. Even with regard to thinner coatings, if the surface smoothness is increased, the heat fusible ink can be peeled off. However, fixation of images decreases. In the above cited patent application publication, plain materials such as PET and laminate films having a smoothness of at least 300 seconds as measured by a Bekk smoothness tester are used as substrates. That a coating has the above-mentioned migration means that the effect of the coating as a releasing agent may be reduced upon repeated reuse. In short, the cause of migration is weak bonding such as in the case where a coating is merely applied or deposited onto a support.

On the other hand, when an image recording material is fixed on a coating having a sufficient thickness (e.g., 3 $\mu$m or more) that a heat fusible ink may be peeled off, the fixation will be so poor that some fixed images may be easily peeled off only by rubbing with hands. Thus, the storage stability of recording is poor.

In short, the technique disclosed in the publication is unsatisfactory in the migration of coatings, fixation of images and peelalility.

Japanese Patent Application laid Open (JP-A) No. 5-216376 discloses a recording medium (paper) comprising a releasing agent applied on its recording surface. A toner constituting an image is transferred and removed by bringing the medium into contact, under pressure the recording paper, with a medium comprising an easily offsetting material upon erasion of the image. The releasing agent includes silicone oils, fluorinated oils and other aliphatic oils. When these oils are used, they must be applied onto a recording paper at a concentration such that the recording paper should be transparent, in order that the toner may exhibit sufficient peelability. Such a recording paper will be such a low quality that may ruin the impression of plain papers. Further, the fixation of images is also so poor that some fixed images may be easily peeled off only by rubbing with hands. Thus, the storage stability of recording is poor. Additionally, there is observed some migration resulting in the same problems as those of Japanese Patent Application Laid Open (JP-A) No. 2-55295.

Japanese Patent Application Laid Open (JP-A) No. 6-219068 discloses a reusable recording paper wherein a thermally convertible material, such as a fluorine-containing acrylate, whose adhesion with an image forming material will be lowered upon heating, is applied on or incorporated into a recording paper. (Fixation of images are conducted by pressure and the problem of the fixation with heat and pressure is explicitly mentioned.) The recording paper is for thermal transfer and has a higher smoothness than plain papers. Generally, common thermal transfer papers have a smoothness of about 200 seconds or higher as measured by a Bekk smoothness tester. Common plain papers generally have a smoothness of 20 to 100 seconds. If the smoothness exceeds 200 seconds, the impression of specialty papers increases in view of the gloss, touch and writing properties.

In order to obtain satisfactory peelability by coating or impregnating, with a fluorine-containing acrylate material, a plain paper such as a wood free paper or a copying paper having a smoothness of 160 seconds or lower, the thickness of the coating will reach 4 to 5 $\mu$m and the smoothness will be 250 seconds or higher, which is within the field of specialty papers. Further, the fluorine-containing acrylate material has a bad adhesion with a thermal transfer recording paper as a substrate. Therefore it exhibits migration, so that a paper feeding roller and a recording paper may often slip in a copying machine, resulting in clogging of recording papers and/or bad printing due to misregistration. For such reasons, it is required to create a region without being coated or impregnated with the thermally convertible material on a portion of the thermal transfer recording paper; therefore it is not easy to manufacture the recording paper, resulting in a higher cost of manufacture. Further, in the electrophotographic copying machine commonly used at present, an image forming material is fixed by subjecting the recording paper to heat and pressure; therefore, the use of fixation of images with pressure only is too low in flexibility.

In the above-mentioned recording papers, the concentration of a recorded image by writing with a pencil, ball pen or aqueous pen will be low and the image is obscure, or they will repel recording materials for such writing.

In each of the above-mentioned techniques, when a color image where the whole thereof is printed in a solid form is formed by an image forming device using an electrophotographic or thermal transfer method, reproduction of the media is not easy because of poor peelability of the image thereon.

SUMMARY OF THE INVENTION

Accordingly, an object of the present invention is to provide an image recording medium which is capable of being reused in situ by an individual without relying upon any expert in the art and which does not hurt the impression of plain papers.

Another object of the present invention is to provide an image recording medium capable of reuse which permits an image forming material to be removed without damaging the recording surface.

A still further object of the present invention is to provide an image recording medium on which various image forming materials are applicable such as inks from pencils, ball pens, aqueous pens and oily pens.

Further, still another object of the present invention is to provide an image recording medium capable of being easily reused even when either a monochromatic or color image is printed in a solid form on the whole surface by an image forming device.

Further, in a preferred embodiment of the present invention, a peelable material substantially does not have migration to others. Thus, it can overcome the problems concerning the paper-supply into a recording device, such as the paper clogging.

The present inventors have eagerly studied a reusable image recording medium and completed the present invention which can attain the above-mentioned objects.

A reusable image recording medium capable of formation and removal of images according to the present invention comprises a substrate and a coating formed on a surface of said substrate and having a recording surface of an image forming material-peelability, wherein said recording surface has a surface smoothness of 200 seconds or lower as measured by a Bekk smoothness tester.

Such essential characteristics are important factors so as to well fix an image forming material such as an ink onto the recording surface and to smoothly peel off the image forming material from the recording surface.

The unevenness on the recording surface also contributes to runnability of the image recording medium. For instance, friction due to the unevenness on the image recording medium is required to certainly retain and transfer each of the image recording media by a traveling means such as a traveling rubber roller. If the surface smoothness is higher, the friction will decrease and the traveling means and the image recording medium will easily slip, causing clogging of image recording media. From this viewpoint as well, the surface smoothness of 200 seconds or lower is suitable.

The surface smoothness as measured in a Bekk tester is well known in the art (see, for example, Japanese Industrial Standards, JIS P 8119). The larger the value thereof, the higher the degree of smoothness.

The "image forming material-peelability" used herein means that peelability of an image once formed and fixed is at least higher than the peelability of an image fixed on the substrate per se.

When the coating has a thickness of 2 microns or less, there is provided a particularly practically preferred image recording paper which does not damage the impression of plain papers.

In the image recording medium of the present invention, preferably, at least the surface of the substrate is made of a material reactive with a curable silicone compound, the coating is a film comprising a reaction product of the curable silicone compound, and said reaction product is partially reacted with and bonded to the substrate. Particularly preferably, the coating is formed by applying a liquid composition comprising a curable silicone compound followed by drying.

According to this embodiment, the coating has a peelability from the image forming material while the coating per se is not removed from the substrate, in other words, it is not migrated to others. Therefore, the reusable image recording medium not only facilitates satisfactory peeling of the image forming material but also maintains the effect semipermanently, in spite of a thin coating. A particularly preferred substrate comprises a pulp.

To provide especially excellent peelability of image forming materials and durability, it is preferred that said liquid composition comprises a modified silicone oil having a reactive group in the molecule in addition to the curable silicone compound.

According to another preferred aspect of the present invention, there is provided a reusable image recording medium capable of formation and removal of images which comprises a substrate comprising a pulp and a coating film formed on a surface of said substrate and having a recording surface with image forming material-peelability, wherein said recording surface has a smoothness of 200 seconds or lower as measured by a Bekk smoothness tester and said coating film comprises a reaction product of a curable silicone compound per se and a reaction product of the curable silicone compound and the substrate.

DESCRIPTION OF PREFERRED EMBODIMENTS OF THE INVENTION

The reusable image recording medium of the present invention capable of formation and removal of images will be described in detail with reference to preferred embodiments thereof.

The image recording medium of the present invention has a coating or film on the surface of a substrate. The substrate should have unevenness for imparting a smoothness required by the present invention to the coating.

The surface of the coating (i.e., the recording surface of the image forming material on which an image is to be recorded) exhibits image forming material-peelability. The recording surface has a surface smoothness of 200 seconds or lower as measured by a Bekk smoothness tester. Preferably, the smoothness is 20 seconds or higher, in particular 30 seconds or higher, the values of surface smoothness shown herein being as measured by a Bekk smoothness tester.

Generally, coatings tend to reduce the specific surface area of a substrate and to worsen the fixation of an image forming material on a substrate. However, the use of a substrate whose surface has an appropriate unevenness and roughness such that the recording surface of the coating has a smoothness as specified above serves to provide satisfactory and well-balanced fixation and peelability of images. Said appropriate unevenness and roughness are such that the substrate per se usually has a surface smoothness of 160 seconds or lower, for example, 20 to 100 seconds.

Preferably, the coating has a thickness of 2 $\mu$m or lower. Thus, the coating is not too thick; accordingly, when a substrate has the above-mentioned appropriate smoothness, the smoothness can be reflected on the surface of the coating and generally the smoothness of the coating surface can be maintained to 200 seconds or lower.

The coating may be made of any material so far as it is applied onto the substrate in such a manner that the requirements with respect to the smoothness can be satisfied. Preferably, a coating material can be chemically bonded to the substrate to form a coating in order to efficiently prevent the separation, i.e., migration, of the coating per se.

Preferably, a substrate material has a reactive, functional group such as a hydroxyl, carboxyl amino or SiH group and a coating material has a curable silicone compound which is directly reactive with said functional group and has an image forming material-peelability.

For example, a pulp may be preferably used as the substrate material comprising a substance having a hydroxyl group. A preferred chemical pulp is a virgin bleached or unbleached pulp prepared by chemical treating a wood or other fibrous material and optionally bleaching it, for example, a hardwood bleached or unbleached kraft pulp, a hardwood bleached sulfite pulp, a coniferous bleached or unbleached kraft pulp, a coniferous bleached sulfite pulp, or a soda pulp. Those having a higher whiteness are more preferred. Preferred waste pulps include, for example, (I) those obtained by cooling non-printed waste papers such as a topmost, a special white, and a medium white which are cut, broken or end portion-cut waste papers produced in a bindery, printing press and tailor; (II) those obtained by cooking i) printed waste paper such as wood free paper, wood free coated paper, medium quality paper, medium quality coated paper, ground wood paper printed by planographic, letterpress or intaglio printing, electrophotographic, thermographic, thermal transfer, pressure sensitive recording or ink jet recording method, or through a carbon paper, ii) waste paper on which letters are written with an aqueous or oily ink or with a pencil, or iii) waste newspaper, followed by deinking each waste paper in a respective optimum manner; and (III) those waste pulps of planographically printed waste paper which is relatively easy to deink. Among them, those waste pulps having a higher whiteness and a lower contaminant content are more preferred.

The curable silicone compound of the coating material reactive with the functional group in the substrate is provided on an image recording paper as a substrate made from such a pulp as described above, and directly chemically reacts with celluloses which are main components of the pulp fibers, in particular with their hydroxyl groups. Thus, excessive impregnation of a molten image forming material can be prevented during the image fixation step and the remaining amount of the image forming material can be reduced during the image peeling step as well.

The coatings may vary in their reactivity, affinity and peelability with the image forming material depending upon their material and composition. The unevenness and roughness of the coating surface may also vary with the nature of the image recording paper (substrate). Generally, plain papers prepared from the above-mentioned pulp (e.g., wood free paper, medium quality paper, groundwood paper, copying paper) have such unevenness that the surface smoothness ranges from 20 to 100 seconds (i.e., within the above-specified appropriate range). When these plain papers are used, it is easy for the coating thereon to satisfy the above-specified requirements with respect to the surface smoothness. Thus, the resulting image recording medium has good and well-balanced fixation and peelability.

When a coating is provided on an image recording paper as a substrate, the coating preferably is a thickness of 2 $\mu$m or lower. If the thickness exceeds 2 $\mu$m, the smoothness will often be higher than 250 seconds and an impression as a plain paper may be damaged. Also, even though the paper has an uneven surface, fixation of the image forming material is deteriorated and problems of offset and low runnability of papers may occur.

The thickness (t) of the coating is more preferably in the range of $0.01 \leqq t \leqq 2$ $\mu$m; particularly preferred is the range of 0.02 to 1 $\mu$m. If the thickness t is less than 0.01 $\mu$m, the coating may partially not be formed. Furthermore, even a portion where the coating is formed, it may be so thin that it cannot follow the pulp fibers and may be destroyed when the paper is bended. In these portions, therefore, the image forming material may be penetrated into the pulp fibers and it will be difficult to peel the penetrated image forming material.

The coating of the curable silicone compound, which undergoes direct chemical reaction with the substrate such as pulp fibers, may be prepared in any manner; typically, it may be prepared by applying a liquid composition containing the curable silicone compound on the substrate by coating or impregnation followed by drying.

The curable silicone compound is any silane compound having a functional group and is capable of forming a cured coating by combination with itself (i.e., other molecules or other silane compound(s) having a functional group, but that silicone oils are excluded.

The curable silicone compounds typically include fluorine-containing silicone compounds, isocyanatosilane compounds, alkoxysilane compounds, silane coupling agents and silane compounds having a SiH group. When paper is used as a substrate, however, the silicone compounds desirably do not contain a reactive chlorine atom since hydrochloric acid produced from such chlorine atoms contained therein may attack the paper and handling thereof such as storage will be difficult to perform. These compounds may also serve to fix in the paper an inorganic fine particle filler usually contained in the paper, such as talc, clay (kaoline) or calcium carbonate, since they are also highly reactive with such a filler and cured with it and the pulp fibers.

The fluorine-containing silicone compounds include, for example, $CF_3(CH_2)_2Si(OCH_3)_3$, $C_6F_{13}C_2H_4SiC_{13}$, $C_6F_{13}C_2H_4Si(OCH_3)_3$, $C_7F_{15}CONH(CH_2)_3Si(OC_2H_5)_3$, $C_8F_{17}C_2H_4SiC_{13}$, $C_8F_{17}C_2H_4Si(OCH_3)_3$, $C_8F_{17}C_2H_4SiCH_3Cl_2$, $C_8F_{17}C_2H_4SiCH_3(OCH_3)$, $C_8F_{17}C_2H_4Si(ON{=}C(CH_3)(C_2H_5))_3$, $C_9F_{19}C_2H_4Si(OCH_3)_3$, $C_9F_{19}C_2H_4Si(NCO)_3$, $(NCO)_3SiC_2H_4C_6F_{12}C_2H_4Si(NCO)_3$, $C_9F_{19}C_2H_4Si(C_2H_5)(OCH_3)_2$, $(CH_3O)_2(CH_3)SiC_2H_4C_8F_{16}C_2H_4Si(CH_3)(CH_3O)_2$, $(CH_3O)_3SiC_2H_4C_8F_{16}C_2H_4Si(OCH_3)_3$, and $(CH_3O)_2(CH_3)SiC_9F_{18}C_2H_4Si(CH_3)(CH_3O)_2$ and hydrolysates or partial hydrolysates of these compounds. Among them, those containing 3 or more methoxy or isocyanato functional groups are particularly preferred.

The isocyanatosilane compounds include $(CH_3)_3SiNCO$, $(CH_3)_2Si(NCO)_2$, $CH_3Si(NCO)_3$, vinylsilyl triisocyanate, $C_6H_5Si(NCO)_3$, $Si(NCO)_4$, $C_2H_5OSi(NCO)_3$, $C_8H_{17}Si(NCO)_3$, $C_{18}H_{37}Si(NCO)_3$, and $(NCO)_3SiC_2H_4Si(NCO)_3$. Among them, those containing 3 or more isocyanato functional groups are particularly preferred.

The alkoxysilane compounds include $Si(OCH_3)_4$, $CH_3Si(OCH_3)_3$, $HSi(OCH_3)_3$, $(CH_3)_2Si(OCH_3)_2$, $CH_3SiH(OCH_3)_2$, $C_6H_5Si(OCH_3)_3$,$Si(OC_2H_5)_4$, $CH_3Si(OC_2H_5)_3$, $(CH_3)_2Si(OC_2H_5)_2$, $H_2Si(OC_2H_5)_2$, $C_6H_5Si(OC_2H_5)_3$, $(CH_3)_2CHCH_2Si(OCH_3)_3$, $CH_3(CH_2)_5Si(OCH_3)_3$, $CH_3(CH_2)_7Si(OC_2H_5)_3$, $CH_3(CH_2)_{11}Si(OC_2H_5)_3$, $CH_3(CH_2)_{15}Si(OC_2H_5)_3$, and $CH_3(CH_2)_{17}Si(OC_2H_5)_3$ and hydrolysates or partial hydrolysates of these silane compounds. Among them, those having 3 or more functional groups are particularly preferred. Silane compounds having a SiH group do not fall within the category of the above mentioned compounds and are silane compounds having a SiH group and a functional group.

The silane coupling agents include vinylsilanes such as vinyltris(β-methoxyethoxy)silane, vinyltriethoxysilane and vinyltrimethoxysilane; acrylsilanes such as γ-methacryloxypropyltrimethosilane; epoxysilanes such as β-(3,4-epoxycyclohexyl) ethyltrimethoxysilane, γ-glycidoxypropyltrimethoxysilane, and γ-glycidoxypropylmethyldiethoxysilane; aminosilanes such as N-β-(aminoethyl)γ-aminopropyltrimethoxysilane,N-β-(aminoethyl) γ-aminopropylmethyldimethoxysilane, γ-aminopropyltriethoxysilane, and N-phenyl-γ-aminopropyltrimethoxysilane. Among them, those having 3 or more functional groups are particularly preferred.

Other silane coupling agents include silane compounds such as $HSC_3H_6Si(OCH_3)_3$ and $ClC_3H_6Si(OCH_3)_3$ as well as hydrolysates and partial hydrolysates of these silane compounds.

It is particularly preferred to use a modified silicone oil having a reactive group introduced into the molecule together with the above curable silicone compound so as to improve the peelability of image forming materials and durability. The modified silicone oil having a reactive group introduced into the molecule means organic silicon compounds which are oily at ordinary or ambient temperature and into which any reactive group such as a group having a reactive hydrogen is introduced.

Examples thereof include silanol-, carboxyl-, amino-, epoxy-, carbinol-, methacryl-, mercapto- and phenol-modified silicone oils as well as methylhydrogensilicone oil. Among them, the silanol-, carboxyl- and amino-modified silicone oils and methylhydrogensilicone oil are preferred since most of them are transparent and colorless and can be used without coloring the substrate even when the substrate is made of a pulp or paper. Different reactive group modified silicone oils are also preferred which contain different reactive groups from each other, for example, amino and alkoxy groups, in a molecule. Any other modified silicone oils would be effective so far as there are no problems of coloring or discoloration.

When the modified silicone oil and curable silicone oil compound are used together, any compositional ratio thereof may be employed depending upon the desired use thereof. Preferably, the ratio of the modified silicone oil to the curable silicone compound is in the range of 1 to 40% by weight. When too small amount of modified silicone oil is used, it will be difficult to peel fixed image forming material. When too modified silicone oil is used, the fixation of image forming material may be deteriorated, the substrate surface may be sticky, and/or the substrate may become transparent when it is a paper.

The interaction of the modified silicone oil and curable silicone compound effectively contributes to the improvement of the peelability of the image forming material of the coating and the durability of the coating. The exact mechanism is not elucidated; it is believed that the chain of the modified silicone oil complicatedly interwinds with the curable silicone compound and consequently controls the fine (micro) distribution of various organic groups present on the surface, in particular polar groups and ionic bonding groups, resulting in achieving an optimum surface structure for the peeling of the image forming material. The interwinding of molecules between selected compounds may also contribute to further enhancement of the durability.

It is believed that the complex interwinding of both the curable silicone compound and the modified silicone oil when used together plays a significant role since the peelability of image forming material and the durability of the coating are certainly improved.

In an isocyantosilane compound into which a carbonyl group is introduced, it is believed that the interwinding is advantageously not easily destroyed even under influence of external energetic actions such as heat and light, since the polarity of the carboxyl group produces an elastic interaction with the isocyanatosilane compound. Therefore, the effect of the invention can be retained for a long period of time.

The viscosity of the modified silicone oil should be selected by taking the combination with the curable silicone oil into consideration and preferably is in the range of 5 to 10,000 cSt.

The curable silicone compound may be used alone: preferably any mixture of a plurality of compounds or partial hydrolysates thereof may be used.

The image forming material peeling coating may be formed by the use of the above-mentioned materials. The curable silicone compound may be mixed with finely divided particles such as silica gel, $SiO_2$ and silicone resins.

Additionally, the liquid composition for forming the coating having the image forming material peelability may further contain any additive, such as an aluminum, titanium, zirconium or fluorine compound, in an amount without affecting the function of the coating, taking into the control of fixation of image forming material, writing properties and reactivity with the substrate. Examples thereof include aluminum isopropylate, aluminum sec-butyrate, aluminum tert-butyrate, tetra-iso-propyl titanate, tetra-n-butyl titanate, tetra-iso-butyl titanate, tetra-sec-butyl titanate, tetra-tert-butyl titanate, tetra-n-pentyl titanate, tetra-iso-pentyl titanate, tetra-n-hexyl titanate, tetra-n-heptyl titanate, tetra-n-octyl titanate, tetra-iso-octyl titanate, tetra-n-nonyl titanate, tetramethyl zirconate, tetraethyl zirconate, tetra-iso-propyl zirconate, tetra-n-propyl zirconate, tetra-n-butyl zirconate, tetra-iso-butyl zirconate, tetra-tert-butyl zirconate, mono-sec-butoxyaluminum diisopropylate, ethylacetoacetatoaluminum diisopropylate, di-n-butoxyaluminum monoethylacetoacetate, aluminum di-n-butoxide methylacetoacetate, aluminum diisobutoxide monomethylacetoacetate, aluminum di-sec-butoxide monoethylacetoacetate, aluminum di-iso-propoxide monoethylacetoacetate, aluminum trisacetylacetonate, aluminum di-iso-propoxide monoacetylacetonate, aluminum monoacetylacetonato bis(ethylacetoacetate), aluminum tris (ethylacetoacetate), cyclic aluminum oxide acylate compounds, di-iso-propoxytitanium bis(acetylacetonate), di-n-butoxytitanium bis(acetylacetonate), tetraoctylene glycol titanate, and tetrakisacetylacetone zirconate. Further, titanium oxide, aluminum oxide, zirconium oxide and barium titanate may be used.

The fluorine compounds include, for example, fluoroolefin resins, such as tetrafluoroethylene, chlorofluoroethlylene, hexafluoropropylene and perfluoropropyl vinyl ether. Any mixture thereof may be used. The fluorine compounds also include perfluoropolyethers represented by the formula X-CD $_2(OC_2F_4)_p(OCH_2)_qOCF_2$—X, such as, for example isocyanato modified products wherein X represents OCN—$C_6H_3(CH_3)$NHCO—, caroxyl group-modified products where X represents —COOH, alcohol modified products where X represents —$CH_2OH$, —$CF_2$—$CH_2((OCH_2CH_2)n)OH$, and ester-modified products where X represents —COOR.

The coating or impregnation method for forming the coating may be any conventional method, such as blade coating, Meyer bar coating, spray coating, dip coating, bead coating, air knife coating, curtain coating, rod bar coating, roller coating and other methods.

The drying method for forming the coating may be air drying; heat drying may further enhance the peelability of image forming materials. The reasons therefor are not elucidated though it is said that the components reacted with the pulp fibers are arranged or oriented. The heat drying may be carried out by introducing into or passing through an oven the medium or bring the medium into contact with a heated roller.

Preferably, the method for removing the image forming material once formed as an image from the image recording medium thus having the peelability with respect to the image forming material is principally identical with the method used to form the image forming material on the image recording medium. For example, in the thermal transfer or electrophotographic method, an image forming material is fixed on an image recording medium paper by the use of heat. In this case, the image forming material on the image recording medium should be fused by again heating the image once fixed, facilitating the removal thereof from the image recording medium. Accordingly, if a fixing apparatus in the image forming device can be used also as a peeling apparatus, the image forming device per se can be advantageously used as an image removing apparatus without need for a separate special apparatus. Further, a vacant space could be efficiently utilized as compared with the case where a separate peeling apparatus should be provided. To assist the removal of image forming materials, the image recording medium paper may be impregnated with an organic solvent dissolving the image forming material, or with an aquous solution or organic solvent containing a surfactant for weakening the bonding of the image forming material with the paper fibers. In addition thereto, the removal of image forming materials may be further promoted by the use of physical actions such as ultrasonic vibration.

The reusable image recording medium according to the present invention can effect the following advantages which are not expected by the conventional reusable recording paper.

Regeneration of recording paper can be easily carried out in situ. By forming a given coating, both quite different properties of image forming materials, i.e., fixation and peelability, can be satisfactorily obtained without damaging the impression of plain paper, which has not been attained by conventional techniques.

The repeating stability is good with respect to the formation and deletion of images.

Further, reuse of media having not only monochromatic copy images but also color copy images as well as solid images of a whole surface is possible.

The cost of paper per copy is reduced, resulting in higher economical merit. Also, from the global atmospheric viewpoint, the reduction of paper resource utilized and amounts of $CO_2$ discharged into the atmosphere (prevention of the warming of the earth) may be expected.

Finally, in the preferred embodiments of the present invention, the curable silicone which has reacted with the substrate surface does not migrate, thereby overcoming the various defects due to the migration. Further, the curable silicone compound has a high reactivity with inorganic fine particles; when a plain paper based on pulp fibers is used as a substrate, the compound reacts with a filler in the plain paper, for example, talc, together with the pulp fibers and can fix the filler in the pulp fibers. Thus, the filler does not affect on members contacting the plain paper.

EXAMPLES

The present invention will be illustrated in more detail by way of examples which do not limit the present invention. "Parts" in the examples and comparative examples are by weight.

Example 1

To a flask with a stirrer, 16.4 parts of the compound of the following formula (I), 5 parts of the compound of the following formula (II) as fluorine-containing silicone compounds and 5.6 parts of tetramethoxysilane were charged, and 600 parts of isopropyl alcohol and 1,400 parts of 2-methyl-2-propanol as solvents were added thereto. Then, 2.2 parts of aluminum trisacetylacetonate as an organic aluminum compound was added and well stirred. To this, 6.7 parts of 1% aqueous hydrochloric acid solution was dropwise added. After completion of the addition, the mixture was maintained at 25° C. and allowed to stand for 7 days to prepare a composition solution.

Further, 2 parts of a silanol-modified dimethylsiloxane having a hydroxyl group at one end of the molecule (ex Toshiba Silicone Co. Ltd., XF3968) as a modified silicone oil was mixed with the composition solution prepared above to yield a coating liquid. With the liquid, A-4 size Xerox J paper (ex Fuji Xerox Co., Ltd., surface smoothness 100) was impregnated, air dryied for 10 minutes and heat dried in an oven at 115° C. for 60 minutes to make a reusable image recording paper having a mean coating thickness of 0.02 $\mu$m. The coating thickness was determined by vacuum depositing gold on the recording paper on which the coating was formed, cutting a sample which was fixed at its peripheries with a resin which did not affect on the pulp fibers and analyzing the sample by observing the cross section and taking a photo with a transmission electron microscope. The surface smoothness was 125 seconds as measured by a Bekk smoothness tester. Color images including letters and solid images were fixed on the recording paper with an electrophotographic apparatus (A color 635, ex Fuji Xerox) and 1,000 copies were continuously taken in a monochromatic mode to investigate the runnability.

The fixition of toners was estimated by applying a commercially available adhesive tape of 18 mm in width (ex Nichiban Co., Ltd., Cellophane tape onto the solid image at the condition of a linear load of 300 g/cm, the solid image having a density of about 1.8 as determined by measuring the image fixed by the above described electrophotographic apparatus with an X-Rite 938 densitometer (ex X-Rite), and peeling the tape at a rate of 10 mm/sec. The fixation is expressed as a ratio of the image density after peeling to the image density before peeling (hereinafter referred to as OD ratio). The OD ratio of 0.8 or higher is required as toner fixation for electrophotographic recording papers.

The reusable recording paper was studied for its writing properties by the use of an HB pencil (ex Mitsubishi Pencil, uni) a black ball pen (ex PILOT Corp., superfine S), an aqueous (fluorescent) pen (ex Zebra, OPTEX), and an oily pen (ex Magic Ink, No. 700).

The running properties were estimated by the number of papers undergoing double supply and/or jamming when 1,000 papers were supplied. Preferably, 2 or less is required for electrophotographic recording papers.

When the recorded image was removed from the recording paper, a heat roller having a silicone rubber surface layer in a fixer of the above-described electrophotographic apparatus was replaced by another heat roller anodized with aluminum and a metal blade for scratching the toner peeled off from the paper was provided on the heat roller. When the recording paper on which an image was recorded was supplied to this fixer of the electrophotographic apparatus, the toner was removed and the image recording paper could be reused.

The remaining toner on the reused paper after removal of toner was estimated by the OD ratio as in the estimation of toner fixation. Acceptable image densities are desirably (OD ratio) 0.08 or less.

The repeating stability was determined by estimating the toner fixation and the remaining toner amount on the reused paper after recording of image on the paper and removal of the image from the paper were repeated 10 times. The results are summarized in Table 1.

Example 2

After a recording paper was impregnated with the liquid composition prepared in Example 1 and air dried, coating was further repeated to form a coating having an average thickness of 1.95 $\mu$m on the recording paper. The recording paper was estimated as in Example 1 and the results are shown in Table 1.

Comparative Example 1

As in Example 2, after a Xerox paper was impregnated with the liquid composition prepared in Example 1 and air dried, coating was further repeated and dried to form a coating having an average thickness of 2.55 $\mu$m on the recording paper. The recording paper was estimated as in Example 1. The writing properties on the paper were such that letters by a ball pen were thin and light, and cissing was partially observed with regard to an aqueous or oily pen. The runnability was also poor and jamming often occurred. Further, fixation of images was also poor and offset partially occurred; therefore, the estimation wherein recording of images on the recording paper and removal of images from the paper were repeated 10 times could not be conducted.

Comparative Example 2

As in Example 1, after an A-4 size was impregnated with the liquid composition prepared in Example 1 thermal transfer paper (ex Matsushita Electric Industrial Co., Ltd., surface smoothness 220) and dried to form a coating having an average thickness of 0.02 $\mu$m on the recording paper. This recording paper was estimated as in Example 1. The writing properties on the paper were such that letters by a ball pen were thin and light, and cissing was partially observed with regard to an aqueous or oily pen. The runnability was also poor and jamming often occurred. Further, fixation of images was also poor and offset partially occurred; therefore, the estimation wherein recording of images on the recording paper and removal of images from the paper were repeated 10 times could not be carried out.

Example 3

Sixty (60) parts of methlylsilyl triisocyanate and 20 parts of phenylsilyl triisocyanate as isocyanatosilane compounds, 8 parts of carbinol polydimethylsiloxane oil (ex Shin-Etsu Chemical Co., Ltd., KF-6003) as a modified silicone oil, 8 parts of monooctyl acid phosphate as other curing reaction regulator, 1,400 parts of ethyl acetate, and 100 parts of diglyme were mixed under stirring to yield a coating liquid. With this an A-4 size Xerox J paper (ex Fuji Xerox) was impregnated, air dried for 5 minutes, and heat dried in an oven at 115° C. for 20 seconds to make a reusable image recording paper comprising a coating of 0.01 $\mu$m in average thickness on the recording paper. This recording paper was estimated as in Example 1. The results are summarized in Table 1.

Example 4

Eighty (80) parts of methylsilyl triisocyanate as an isocyanatosilane compound, 8 parts of a, ω-dihydroxypolydimethylsiloxane oil (viscosity 2,000 centistokes at 25° C.) as a silanol modified silicone oil, 3 parts of dibutyl acid phosphate as a curing reaction regulator, and 2,000 parts of ethyl acetate as a solvent were mixed under stirring to yield a coating liquid. This was treated as in Example 3 to form a coating of 0.02 $\mu$m in average thickness on a recording paper. Thus, a reusable image recording paper was prepared. This recording paper was estimated as in Example 1 and the results are shown in Table 1.

Example 5

Twenty-six (26.0) parts of $C_{18}H_{37}Si(NCO)_3$ as an isocyanatosilane compound and 970 parts of ethyl acetate as a solvent were mixed under stirring, and then 2.6 parts of $C_9F_{19}C_2H_4Si(NCO)_3$ as an additional isocyanatosilane compound and 1.6 parts of a carboxyl-modified silicone oil (ex Shin-Etsu Chemical Co., Ltd., X-22-3710) were added thereto. The mixture was mixed under stirring at 25° C. for one day and night to yield a coating liquid. This was applied as in Example 3 on a wood free paper (Nippon Paper Industries Co., Ltd., surface smoothness 160 seconds) to form a coating of 0.03 $\mu$m in average thickness on the recording paper. Thus, a reusable image recording paper was made. This recording paper was estimated as in Example 1 and the results are summarized in Table 1.

Example 6

Ten (10.0) parts of $C_{18}H_{37}Si(NCO)_3$ as an isocyanatosilane compound and 970 parts of ethyl acetate as a solvent were mixed under stirring, and then 6.0 parts of $C_9F_{19}C_2H_4Si(NCO)_3$, 10.0 parts of $C_8H_{17}Si(NCO)_3$ and 2.6 parts of methylsilyl triisocyanate and 1.6 parts of said carboxy-modified silicone oil were added thereto and treated as in Example 5 to yield a coating liquid. This was applied as in Example 3 on a medium quality paper (ex Nippon Paper Industries Co., Ltd, surface smoothness 45 seconds to form a coating of 0.04 μm in average thickness on the recording paper. Thus, a reusable image recording paper was made. This recording paper was estimated as in Example 1 and the results are shown in Table 1.

Example 7

Twenty (20.0) parts of $C_9F_{19}C_2H_4Si(NCO)_3$ as an isocyanatosilane compound and 970 parts of ethyl acetate as a solvent were mixed under stirring, and then 4.6 parts of $(NCO)_3SiC_2H_4C_6F_{12}C_2H_4Si(NCO)_3$ and 4.0 parts of $Si(NCO)_4$, 1.6 parts of a silanol-modified silicone oil (ex Shin-Etsu Chemical Co., Ltd., X-22-160AS) and 3.0 parts of monooctyl acid phosphate as a curing reaction regulator were added thereto and mixed under stirring to yield a coating liquid. This was treated as in Example 3 to form a coating of 0.03 μm in average thickness on a recording paper. Thus, a reusable image recording paper was made. This recording paper was estimated as in Example 1 and the results are summarized in Table 1.

Examples 8 to 13

Each of the coating liquids obtained in Examples 1 and 3 to 7 was applied as in each Example on an A-4 size fine PPC paper containing a large amount of talc (ex Kishu Paper Co., Ltd., surface smoothness 35 seconds) to make a reusable image recording paper. Migration of talc to the surface of a photoreceptor in a copying machine was investigated. To a revised copying machine Able 1301a (Fuji Xerox) in which a cleaner provided on the photoreceptor was removed, 1,000 pieces of each of the above image recording paper were supplied under conditions of 28° C. and RH 85% and thereafter the surface of the photoreceptor was observed. On the other hand, the quality of a photoreceptor was observed in an unrevised Able 1301a copying machine. There was no heavy stain on the surface of the photoreceptor and the image quality was not problematic. The results are shown in Table 2.

Comparative Example 3

The fine PPC paper used in Example 8 was estimated as in Example 8 without any treatment. No recording paper could be reused. Materials like thin and white films were adhered on the surface of a photoreceptor in the copying machine. The image quality of the photoreceptor was estimated; blurring occurred and letters and pictures could not be discriminated at all. It was found by analysis that said white films on the surface were mainly talc contained in the fine PPC paper.

TABLE 1

| | | | Initial | | | | | | | After 10 Repeated Regeneration | |
|---|---|---|---|---|---|---|---|---|---|---|---|
| | Coating | Surface | Toner | After | Writing Properties | | | | | Toner | After |
| | Thickness (μm) | Smoothness (sec) | Fixation (OD ratio) | Peeling Toner (OD ratio) | Pencil | Ball Pen | Aqueous Pen | Oily Pen Pen | Runnability | Fixation (OD ratio) | Peeling Toner (OD ratio) |
| Ex. 1 | 0.02 | 105 | 0.97 | 0.05 | A | A | A | A | 0 | 0.93 | 0.06 |
| Ex. 2 | 1.95 | 198 | 0.83 | 0.02 | A | A | A | A | 2 | 0.83 | 0.03 |
| Comp. Ex. 1 | 2.55 | 247 | 0.68 | 0.01 | A | B | C | C | 16 | — | — |
| Comp. Ex. 2 | 0.02 | 232 | 0.67 | 0.01 | A | B | C | C | 12 | — | — |
| Ex. 3 | 0.01 | 103 | 0.95 | 0.07 | A | A | A | A | 1 | 0.93 | 0.08 |
| Ex. 4 | 0.02 | 106 | 0.94 | 0.04 | A | A | A | A | 1 | 0.94 | 0.04 |
| Ex. 5 | 0.03 | 176 | 0.95 | 0.03 | A | A | A | A | 0 | 0.93 | 0.05 |
| Ex. 6 | 0.04 | 60 | 0.93 | 0.03 | A | A | A | A | 0 | 0.92 | 0.04 |
| Ex. 7 | 0.03 | 109 | 0.94 | 0.04 | A | A | A | A | 1 | 0.94 | 0.04 |

A: Good
B: Acceptable
C: Bad

TABLE 2

| | | | Initial | | | | | | | After 10 Repeated Regeneration | |
|---|---|---|---|---|---|---|---|---|---|---|---|
| | Coating | Surface | Toner | After | Writing Properties | | | | | Toner | After |
| | Thickness (μm) | Smoothness (sec) | Fixation (OD ratio) | Peeling Toner (OD ratio) | Pencil | Ball Pen | Aqueous Pen | Oily Pen Pen | Runnability | Fixation (OD ratio) | Peeling Toner (OD ratio) |
| Ex. 8 | 0.02 | 39 | 0.97 | 0.05 | A | A | A | A | 0 | 0.93 | 0.06 |
| Ex. 9 | 0.01 | 36 | 0.98 | 0.07 | A | A | A | A | 1 | 0.93 | 0.05 |
| Ex. 10 | 0.02 | 37 | 0.96 | 0.04 | A | A | A | A | 1 | 0.94 | 0.04 |
| Ex. 11 | 0.03 | 40 | 0.95 | 0.03 | A | A | A | A | 0 | 0.93 | 0.05 |
| Ex. 12 | 0.04 | 45 | 0.93 | 0.03 | A | A | A | A | 0 | 0.92 | 0.04 |

TABLE 2-continued

| | Coating Thickness (μm) | Surface Smoothness (sec) | Initial: Toner Fixation (OD ratio) | Initial: After Peeling Toner (OD ratio) | Writing Properties: Pencil | Writing Properties: Ball Pen | Writing Properties: Aqueous Pen | Writing Properties: Oily Pen Pen | Runnability | After 10 Repeated Regeneration: Toner Fixation (OD ratio) | After 10 Repeated Regeneration: After Peeling Toner (OD ratio) |
|---|---|---|---|---|---|---|---|---|---|---|---|
| Ex. 13 | 0.03 | 38 | 0.94 | 0.04 | A | A | A | A | 0 | 0.94 | 0.04 |
| Comp. Ex. 3 | — | 35 | 0.99 | 0.96 | A | A | A | A | 1 | — | — |

A: Good
B: Acceptable
C: Bad

Example 14

Twenty-eight (28.0) parts of $CH_3Si(OCH)_3$ as an alkoxysilane compound and 970 parts of ethyl acetate as a solvent were mixed under stirring, and then 2.0 parts of methylhydrogensilicone oil (ex Shin-Etsu Chemical Co., Ltd., KF99) was added and mixed under stirring to yield a coating liquid. With this an A-4 size Xerox JD paper (ex Fuji Xerox, surface smoothness 110±5 seconds on average) was impregnated, air dried for 5 minutes, and heat dried in an oven at 120° C. for 1 minute to prepare a paper having an image forming material peeling-recording surface on the recording paper. The coating had a thickness of about 0.01 μm and the surface smoothness of the paper was about 111 seconds. This recording paper was estimated as in Example 1 and the results are summarized in Table 3.

Example 15

Twenty-five (25.0) parts of trimethoxyvinylsilane as a silane coupling agent, 15.0 parts of tetraisocyanatosilane as an isocyanatosilane compound and 960 parts of ethyl acetate as a solvent were mixed under stirring, and then 1.5 parts of an additional amino-modified silicone oil (ex Toshiba Silicone, TSF4702) was added thereto and mixed under stirring to yield a coating liquid. This was applied as in Example 14 on a recording paper. The coating thickness was about 0.01 μm and the smoothness of the paper surface was 112 seconds on average. This recording paper was estimated as in Example 1 and the results are shown in Table 3.

Example 16

Thirty (30.0) parts of γ-(methacryloxypropyl) trimethoxysilane (ex Shin-Etsu Chemical Co., Ltd., KBM503) as a silane coupling agent and 2.0 parts of α, ω-dihydroxypolydimethylsiloxane oil (viscosity 1,000 centistokes at 25° C.) as a silanol-modified silicone oil were mixed under stirring to yield a coating liquid. This was applied as in Example 14 on a recording paper. The coating thickness was about 0.01 μm and the surface smoothness of the paper was 110 seconds on average. This recording paper was estimated as in Example 1 and the results are summarized in Table 3.

Example 17

Twenty-eight (28.0) parts of $CH_3Si(OCH_3)_3$ as an alkoxysilane compound and 970 parts of ethyl acetate as a solvent were mixed under stirring, and then 1.0 part of dimethylsiloxane oil (ex Toshiba Silicone, YF3800) as a silanol-modified silicone oil and 1.0 part of methylhydrogensilicone oil (ex Shin-Etsu Chemical Co., Ltd., KF99) were further added thereto and mixed under stirring to yield a coating liquid. This was applied as in Example 14 on a recording paper. The coating thickness was about 0.01 μm and the surface smoothness of the paper was 110 seconds on average. This recording paper was estimated as in Example 1 and the results are summarized in Table 3.

Example 18

Thirty-two (32.0) parts of $CH_3Si(OCH_3)_3$ as an alkoxysilane compound and 1,000 parts of ethyl acetate as a solvent were mixed under stirring, and then 1.0 part of dimethylsiloxane oil (ex Toshiba Silicone, YF3800) as a silanol-modified silicone oil and 1.5 parts of an amino-modified silicone oil (ex Toshiba Silicone, TSF4702) were further added thereto and mixed under stirring to yield a coating liquid. This was applied as in Example 14 on a recording paper. The coating thickness was about 0.01 μm and the surface smoothness of the paper was 112 seconds on average. This recording paper was estimated as in Example 1 and the results are summarized in Table 3.

Example 19

Ten (10.0) parts of $MeSi(NCO)_3$ as an isocyanatosilane compound and 970 parts of ethyl acetate as a solvent were mixed under stirring, and then 5.0 parts of $MeHSi(OCH_3)_2$ as a silane compound having a SiH group, 5.0 parts of $CH_3(CH_2)_{11}Si(OC_2H_5)_3$ as an alkoxysilane compound and 1.5 parts of a silanol-modified methylphenylsilicone oil (ex Toshiba Silicone, TSF431) were further added thereto and mixed under stirring to yield a coating liquid. This was applied as in Example 14 on a recording paper. The coating thickness was about 0.01 μm and the surface smoothness of the paper was 111 seconds on average. This recording paper was estimated as in Example 1 and the results are summarized in Table 3.

Example 20

Twelve (12.0) parts of $CH_3Si(OC_2H_5)_3$, 10 parts of $CH_3(CH_2)_{15}Si(OC_2H_5)_3$ and 8 parts of $CH_2{=}CHCH_2Si(OC_2H_5)_3$ as alkoxysilane compounds and 970 parts of ethyl acetate as a solvent were mixed under stirring, and then 1.0 part of methylhydrogensilicone oil (ex Shin-Etsu Chemical Co., Ltd., KF99) and 0.6 parts of a silanol-modified silicone oil (ex Shin-Etsu Chemical Co., Ltd, X-22-4015) were added thereto and mixed under stirring to yield a coating liquid. This was applied as in Example 14 on a recording paper. The coating thickness was about 0.01 μm and the surface smoothness of the paper was 111 seconds on average. This recording paper was estimated as in Example 1 and the results are summarized in Table 3.

TABLE 3

| | Coating Thickness (μm) | Surface Smoothness (sec) | Initial: Toner Fixation (OD ratio) | Initial: After Peeling Toner (OD ratio) | Initial: Writing Properties: Pencil | Initial: Writing Properties: Ball Pen | Initial: Writing Properties: Aqueous Pen | Initial: Writing Properties: Oily Pen Pen | Initial: Runnability | After 10 Repeated Regeneration: Toner Fixation (OD ratio) | After 10 Repeated Regeneration: After Peeling Toner (OD ratio) |
|---|---|---|---|---|---|---|---|---|---|---|---|
| Ex. 14 | 0.01 | 111 | 0.97 | 0.05 | A | A | A | A | 0 | 0.96 | 0.05 |
| Ex. 15 | 0.01 | 112 | 0.98 | 0.07 | A | A | A | A | 0 | 0.97 | 0.08 |
| Ex. 16 | 0.01 | 110 | 0.97 | 0.06 | A | A | A | A | 0 | 0.96 | 0.07 |
| Ex. 17 | 0.01 | 110 | 0.95 | 0.04 | A | A | A | A | 0 | 0.93 | 0.06 |
| Ex. 18 | 0.01 | 112 | 0.94 | 0.04 | A | A | A | A | 0 | 0.92 | 0.07 |
| Ex. 19 | 0.01 | 111 | 0.95 | 0.04 | A | A | A | A | 0 | 0.94 | 0.08 |
| Ex. 20 | 0.01 | 111 | 0.97 | 0.04 | A | A | A | A | 0 | 0.96 | 0.07 |

A: Good
B: Acceptable
C: Bad

As seen from Tables 1 to 3 above, the examples of the present invention have excellent properties such as toner fixation, toner peelability and runnability in both initial use and after repeated use.

What is claimed is:

1. A reusable image recording medium capable of formation and removal of images comprising a substrate and a coating formed on a surface of said substrate and having a recording surface with image forming material-peelability, wherein the surface of said substrate is made of a material reactive with a curable silicone compound, said coating is a membrane comprising a reaction product of the curable silicone compound, and a part of the reaction product has also reacted with and is bonded to the substrate.

2. The reusable image recording medium of claim 1, wherein said coating is formed by applying a liquid composition comprising the curable silicone compound on the substrate followed by drying.

3. The reusable image recording medium of claim 2, wherein said liquid composition comprises a modified silicone oil having a reactive group in the molecule in addition to the curable silicone compound.

4. The reusable image recording medium of claim 3, wherein said modified silicone oil comprises at least one silicone oil selected from the group consisting of silanol-, carboxyl-, amino-, epoxy-, carbinol-, methacryl-, mercapto- and phenol-modified silicone oils and methylhydrogensilicone oils.

5. The reusable image recording medium of claim 1, wherein said material reactive with a curable silicone compound contains a hydroxyl, carboxyl, amino or SiH group as a functional group reactive with the curable silicone compound.

6. The reusable image recording medium of claim 5, wherein said material reactive with a curable silicone compound is pulp fibers.

7. The reusable image recording medium of claim 1, wherein said curable silicone compound comprises at least one compound selected from the group consisting of fluorine-containing silicone compounds, isocyanatosilane compounds, alkoxysilane compounds, silane coupling agents and silane compounds having an SiH group.

8. A reusable image recording medium capable of formation and removal of images comprising a substrate and a coating formed on a surface of said substrate and having a recording surface with image forming material-peelability, wherein said recording surface has a surface smoothness of 200 seconds or lower as measured by a Bekk smoothness tester, and wherein said coating is a membrane comprising a reaction product of a curable silicone compound, and a part of the reaction product has also reacted with and is bonded to the substrate.

* * * * *